US008061174B2

(12) United States Patent
Szuba et al.

(10) Patent No.: US 8,061,174 B2
(45) Date of Patent: Nov. 22, 2011

(54) PREVENTING VOIDS IN EXTRUDED TEETH OR SPLINES

(75) Inventors: Joseph Szuba, Dearborn, MI (US); Rodney G. Whitbeck, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 693 days.

(21) Appl. No.: 12/245,142

(22) Filed: Oct. 3, 2008

(65) Prior Publication Data

US 2010/0083724 A1 Apr. 8, 2010

(51) Int. Cl.
*B21C 23/18* (2006.01)
*B21D 22/02* (2006.01)

(52) U.S. Cl. ..... 72/267; 72/358

(58) Field of Classification Search ..... 72/264, 72/266, 267, 269, 273, 352, 354.6, 253.1, 72/358, 359; 470/25, 26; 409/58–60, 31, 409/281, 282, 904

See application file for complete search history.

(56) References Cited

U.S. PATENT DOCUMENTS

| | | | |
|---|---|---|---|
| 4,692,071 | A | 9/1987 | Hirota |
| 4,770,572 | A | 9/1988 | Ohkawa et al. |
| 4,772,368 | A | 9/1988 | Rabian |
| 5,465,597 | A | 11/1995 | Bajraszewski et al. |
| 5,538,369 | A | 7/1996 | Okuda |
| 5,551,270 | A | 9/1996 | Bajraszewski et al. |
| 6,204,466 | B1 | 3/2001 | Tabor |

*Primary Examiner* — Debra Sullivan

(74) *Attorney, Agent, or Firm* — David B. Kelley; MacMillan, Sobanski & Todd, LLC

(57) ABSTRACT

An apparatus for extruding teeth in a blank includes a press that includes a lower die plate for supporting the blank thereon, and upper die plate that moves along an axis relative to the lower die plate. A mandrel, aligned with the axis, moves with the upper die plate along the axis, and includes die teeth which form gear teeth to net shape by back extrusion. An impingement ring, located between the upper die plate and the blank, has an opening that allows the die teeth of the mandrel to contact the blank, and includes a stinger that forces material of the blank toward the axis during the forming cycle.

14 Claims, 3 Drawing Sheets

PREVENTING VOIDS IN EXTRUDED TEETH OR SPLINES

BACKGROUND OF THE INVENTION

1. Field of the Invention

This invention relates generally to metal forming operations that apply vertical force to a workpiece, and more particularly to use of a mandrel or punch and die to extrude a metal workpiece without producing a void in the component teeth.

2. Description of the Prior Art

In any cold forming process in which a punch or mandrel is forced vertically through a cylindrical workpiece, the natural flow of the workpiece material is downward toward the bottom of the workpiece and away from end where the punch first enters the workpiece. The direction of the material flow is due to the vertical forces of the press and the momentum it produces. When the teeth are being extruded by the forming process, this material flow usually leaves a void at the open end of the region where incomplete teeth are produced.

Die design can produce a counter flow, called back extrusion, but filling the voided region near the open end of the cylinder is more difficult due to the material being folded forward toward the bottom of the cylinder.

When extruding gear teeth, it is critical to move the workpiece material deep into the root of the mandrel teeth. The back extrusion process is very effective near the bottom of the gear, but near the top there is no mechanism to move the material laterally toward the axis along which the mandrel moves.

A need exists for a technique to prevent extruding incomplete teeth in the workpiece by causing flow of the workpiece material toward the central axis.

SUMMARY OF THE INVENTION

An apparatus for extruding teeth in a cylinder includes a press that includes a lower die plate for supporting the blank thereon, and upper die plate that moves along an axis relative to the lower die plate. A mandrel, aligned with the axis, moves with the upper die plate along the axis, and includes die teeth. An impingement ring, located between the upper die plate and the cylinder blank, has an opening that allows the die teeth of the mandrel to contact the blank, and includes a stinger that forces material on top of the cylinder edge toward the axis as the upper die plate or mandrel forces the impingement ring against the blank.

The invention contemplates a method for extruding teeth in a workpiece using a press that includes an upper die plate that moves along an axis relative to a lower die plate. A mandrel is aligned with the axis, is movable by the press along the axis and includes a surface formed with die teeth. The workpiece is placed on the lower die plate. An impingement ring that includes a stinger contacting the workpiece is placed between the upper die plate and the workpiece. The press is used to force the stinger against the cylindrical workpiece, to force material of the workpiece toward the axis, and to extrude the die teeth into the workpiece as the upper die plate forces the impingement ring and mandrel against the workpiece.

The impingement ring and its stinger can be produced and used simply and at low cost and as part of the die tooling. The stinger causes material of the workpiece to flow toward a void region of the workpiece where incomplete teeth would otherwise be extruded. Use of the impingement ring and its stinger, however, cause complete filling teeth in the rollover zone at the end of the extrusion cycle, producing complete teeth.

Cycle time is shortened because a later trimming and deburring operation is unnecessary.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

The invention will be more readily understood by reference to the following description, taken with the accompanying drawings, in which.

DESCRIPTION OF THE PREFERRED EMBODIMENT

Figure 1:
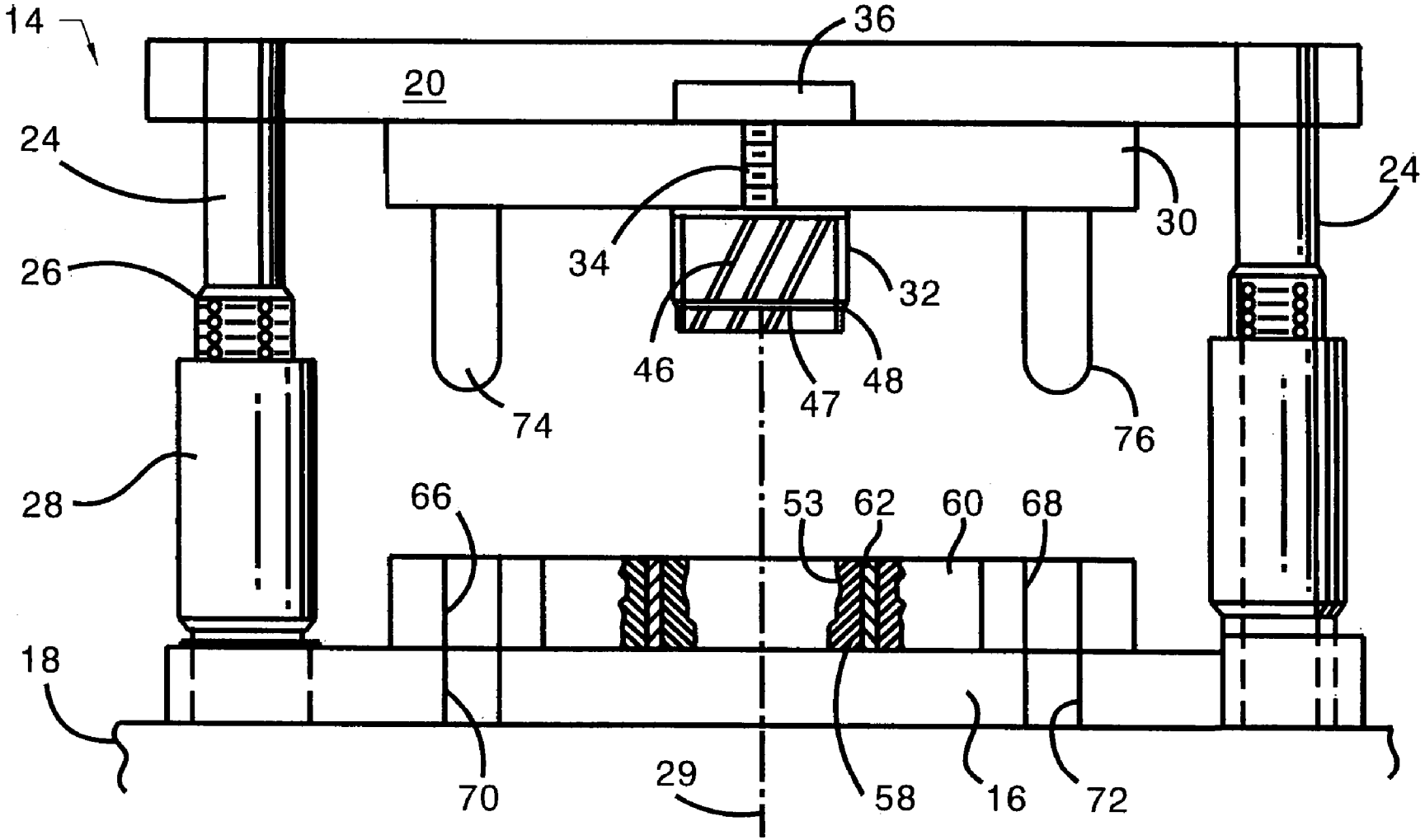
FIG. 1 is a front view of an extrusion die for forming internal helical gear teeth on a gear blank.

Referring now to the drawings, a hydraulic press 14 includes a lower die plate 16, resting on a base portion 18 of the press 14, and an upper die plate 20. Die guide posts 24 extend between upper die plate 20 and lower die plate 16. One end of each die guide post 24 is fixed to the upper die plate 20; the opposite end of each die guide post 24 has a ball bearing cage 26 attached to it. Affixed to lower die plate 16 are guide bushings 28 aligned with a respective ball bearing cage 26. Ball bearing cages 26 telescopically slide into their respective guide bushings 28 to allow axial movement of upper die plate 20 relative to lower die plate 16, minimizing friction and maintaining the two die plates 16, 20 mutually parallel. The upper die plate 20 translates along a vertical axis 29 toward and away from the lower die plate 16.

A support plate 30 that includes guide posts 24 at its lower surface is secured to upper die plate 20 for vertical movement with the upper die plate 20. A mandrel 32 is supported on and secured to the upper die plate 20. Mandrel 32 is formed with external die teeth 46, a lead surface 47, and a transition 48 connecting the lead surface and the body of the mandrel. The helix angle of die teeth 46 is the same as that desired in the teeth to be formed in a workpiece blank 58, such as a gear blank.

The blank 58, supported on the lower die plate 16, includes an annular shell having an internal surface 53 with a precise internal diameter, in which surface the internal helical gear teeth are to be extruded. FIG. 1 shows a blank 58 inserted into a retaining ring 60, and a hardened sleeve 62 located in an annular space between the workpiece 58 and retaining ring. The position of the workpiece 58 is maintained constant and aligned with axis 29 and the forming mandrel 32 by the holes 66, 68, which are bored in retaining ring 60. Each of holes 66, 68 is aligned with a respective hole 70, 72 bored in the lower die plate 16. When the upper die plate 20 is lowered sufficiently, pins 74 enter the aligned bores 66, 70, and pins 76 enter aligned bores 68, 72.

In operation, the gear blank 58 is supported on lower die plate 16 with its open upper end facing mandrel 32. The hydraulic press 14 is activated and forces the upper die plate 20 downward toward lower die plate 16, guided by die the guide posts 24. This axial translation carries mandrel 32 toward gear blank 58 such that the lead surface 47 enters the central opening 53 in the workpiece 58. Then the die teeth 46 on the mandrel are extruded into the material at the inner surface 53 of the workpiece blank 58.

When the mandrel 32 is in its desired angular position, hydraulic press 14 is actuated to continue axial translation of the upper die plate 20.

Die teeth 46 on mandrel 32 engage the inner surface of gear blank 58 and move downward into the material of the workpiece with a helical motion as they are forced into the blank, thereby forming helical gear teeth. When the predetermined depth of finished teeth is reached, hydraulic press 14 stops pressing on upper die plate 20 and retracts the upper die plate and mandrel 32.

The finished ring gear is then removed from press 14 and another blank 58 is inserted in its place preparatory to repeating the forming process.

Figure 2:
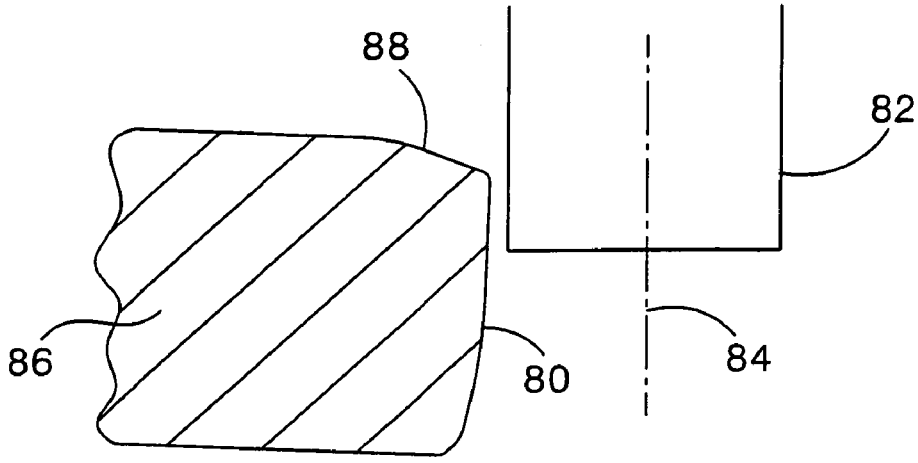
FIG. 2 is a cross section taken at the edge of an interface between a workpiece and a female button used to form the workpiece.

FIG. 2 is a cross section taken at the edge 80 of an interface formed by a punch or mandrel 82 moving downward along axis 84 and forming a hole in a workpiece 86. Rollover of the workpiece material is normally produced in a zone 88 near where the mandrel 82 first enters the workpiece 86 and extending around the periphery of the formed hole in the workpiece. When teeth are to be produced by extruding mandrel 32 into the workpiece 58, the teeth may be incomplete in the area of the rollover zone 88.

Figure 3:
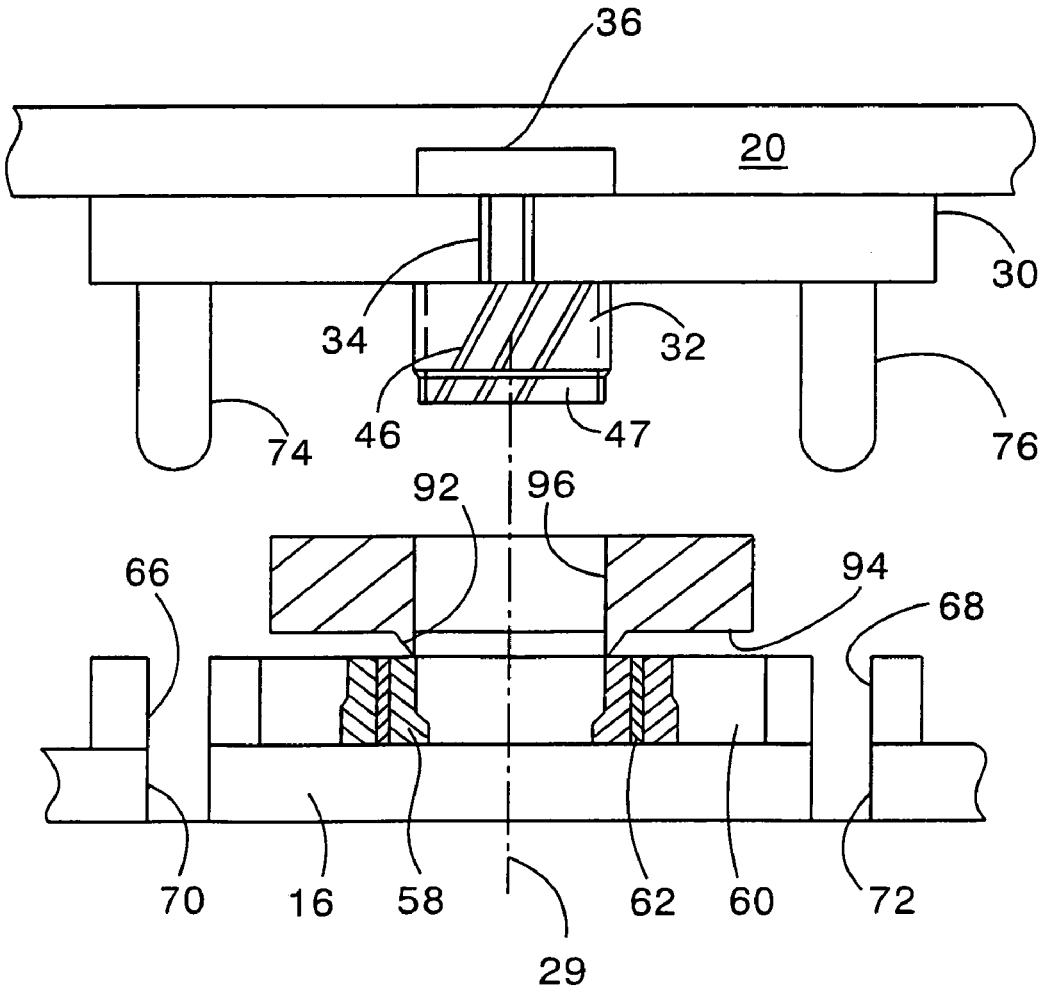
FIG. 3 is front view of a portion of the press of FIG. 1 showing a mandrel, gear blank and impingement ring.

As FIG. 3 illustrates, to prevent incomplete teeth in the extruded blank 58 a hardened impingement ring 90 is placed over the upper surface of the workpiece 58, sleeve 62 and retaining ring 60 such that a circular stinger 92, which extends from the lower surface 94 of the impingement ring, contacts the upper surface of the workpiece. The impingement ring 90 has a central opening 96 that permits mandrel 32 to pass through the impingement ring such that the die teeth 46 are brought into contact with the inner surface 53 of the blank 58.

At, or near the end of the stroke of the hydraulic ram, the stinger, 92, pushes material in the partly formed gear blank 58 laterally, i.e., radially inward toward axis 29 as stinger 92 is forced by the upper die plate 20 into contact with the top of the partly formed blank 58. This displacement of the workpiece material allows the mandrel 32 to produce fully formed teeth along the full thickness of the blank 58 including the rollover zone 88 at the top of the blank.

Figure 4:
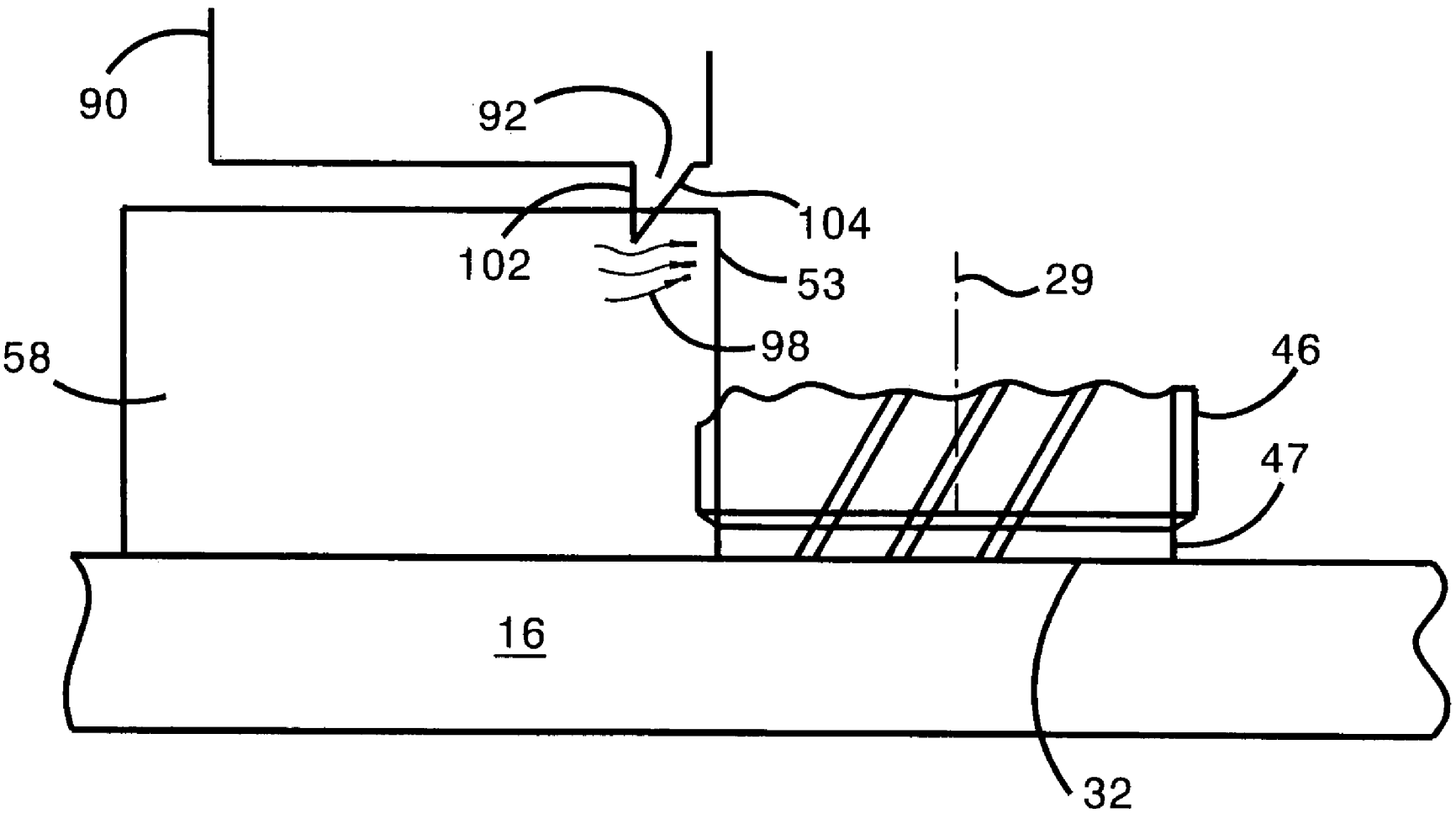
FIG. 4 is front view of a portion of the press of FIG. 1 showing a mandrel, gear blank and impingement ring draw to a larger scale than that of FIG. 3.

FIG. 4 illustrates, to a larger scale than that of FIG. 3, the lateral flow of the gear blank material 98 around the tip of stinger 92 toward axis 29 as the stinger enters the workpiece blank 58. The stinger 92 has an acute angle, preferably of about 45 degrees, between a substantially vertical leg 102 and an inclined inner leg 104 forming a wedge that forces material of the blank 58 into the downward path of mandrel 34 where additional material flow is needed. The material of the blank 58 flows toward axis 29 and fills the volume being at the top of the blank where the die teeth 46 on mandrel 32 are being extruded into the inner surface 53 of the blank.

Although the method is described with reference to forming internal helical teeth in the blank 58, the die teeth on the mandrel 32 may be spur teeth or spline teeth, which may be located on an external surface or an internal surface of the mandrel. The teeth extruded in the blank 58 may be internal or external helical gear teeth, internal or external spur gear teeth, or internal or external spline teeth.

In accordance with the provisions of the patent statutes, the preferred embodiment has been described. However, it should be noted that the alternate embodiments can be practiced otherwise than as specifically illustrated and described.

The invention claimed is:

1. An apparatus for extruding teeth in a blank comprising:

a press that includes a lower die plate for supporting the blank thereon, and upper die plate that moves along an axis relative to the lower die plate;

a mandrel aligned with the axis, moveable with the upper die plate along the axis, and including external die teeth;

a ring supported on the lower die plate and having a cavity concentric with the axis and able to receive the blank therein;

a moveable impingement ring that allows the die teeth of the mandrel to contact and move into the blank, and including a stinger that forces material of the blank toward the axis after the die teeth have formed teeth in the blank.

2. The apparatus of claim 1 wherein the stinger is aligned with the axis, extends from a lower surface of the impingement ring, and includes a first surface, and a second surface inclined at an acute angle with respect to the first surface and forming a pointed annular edge at an end of the first surface, the second surface being inclined away from the pointed edge and toward the axis.

3. The apparatus of claim 1 wherein the stinger is aligned with the axis, and is formed with a wedge which extends from the lower surface of the impingement ring and includes a pointed annular wedge, the wedge including a surface that is inclined toward the axis.

4. The apparatus of claim 1 wherein:

the die teeth are helical die teeth located on an external surface of the mandrel;

the apparatus further comprises:

a servo motor driveably coupled to the mandrel for rotating the mandrel about the axis as the mandrel moves axially relative to the blank; and a retaining ring supported on the lower die plate and having a cavity that is concentric with the axis and able to receive the blank therein.

5. The apparatus of claim 1 wherein:

the die teeth are helical die teeth located on an external surface of the mandrel; and the apparatus further comprises a retaining ring supported on the lower die plate and having a cavity concentric with the axis and able to receive the blank therein.

6. An apparatus for extruding teeth in a workpiece comprising:

a press that includes an upper die plate that moves along an axis relative to the workpiece;

a mandrel including one of helical external die teeth, spur die teeth and spline die teeth located on an external surface of the mandrel, aligned with the axis and the workpiece, moveable forward and then backward along the axis while forming a gear from the workpiece;

an impingement ring including a stinger that forces material of a partially formed gear toward the axis material as the mandrel moves thereby extruding the partially formed gear into a fully formed gear.

7. The apparatus of claim 6 wherein the impingement ring is formed with an opening, though which the die teeth of the mandrel pass into contact with the workpiece.

8. The apparatus of claim 6 wherein the stinger is aligned with the axis, depends from a lower surface of the impingement ring, and includes a first surface, and a second surface inclined at an acute angle with respect to the first surface and forming a pointed annular edge at an end of the first surface, the second surface being inclined away from the pointed edge and toward the axis.

9. The apparatus of claim 6 wherein the stinger is aligned with the axis, and is formed with a wedge that depends from a lower surface of the impingement ring and includes a pointed annular wedge, the wedge including a surface that is inclined toward the axis.

10. The apparatus of claim 6 wherein the die teeth include helical die teeth located on an internal surface of the mandrel.

11. The apparatus of claim 6 wherein the die teeth include one of spur die teeth and spline die teeth located on an internal surface of the mandrel.

12. A method for extruding teeth in a workpiece comprising the steps of:

(a) providing a press;

(b) providing helical external die teeth on a mandrel aligned with an axis, moveable by the press forward and backward along the axis relative to the workpiece;

(c) providing an impingement ring that includes a stinger;

(d) using the press and mandrel to forward extrude partially formed teeth into the workpiece and the stinger to force material of the workpiece toward the axis as the mandrel extrudes the partially formed teeth into fully formed teeth.

13. The method of claim 12 further including the steps of:

stopping axial movement of the mandrel in the workpiece;

using the press to pull the mandrel axially out of the extruded workpiece.

14. The method of claim 12 wherein:

step (b) further includes the step of forming helical die teeth on an inner surface of the gear blank.

* * * * *